US005642704A

United States Patent [19]

Gogots et al.

[11] Patent Number: 5,642,704

[45] Date of Patent: Jul. 1, 1997

[54] ENGINE WIRING HARNESS SUPPORT WITH INTEGRAL OIL SPILL DEFLECTOR

[75] Inventors: Kenneth J. Gogots, Elmhurst; Robert L. Rowells, Elmwood Park; Franco Franchi, Wood Dale, all of Ill.

[73] Assignee: Navistar International Transportation Corp., Chicago, Ill.

[21] Appl. No.: 620,620

[22] Filed: Mar. 22, 1996

[51] Int. Cl.[6] ..... F02B 77/00

[52] U.S. Cl. ..... 123/198 R; 123/196 R

[58] Field of Search ..... 123/90, 37, 196 R, 123/198 R, 446

*Primary Examiner*—Noah P. Kamen

*Attorney, Agent, or Firm*—Dennis K. Sullivan

[57] ABSTRACT

A wiring harness support and under valve cover oil deflector formed from a single sheet metal blank that is connected to each individual injectors, by a single bolt, of a Hydraulically-actuated Electronically-controlled Unit Injector (HEUI) system for a diesel engine. This combined wiring harness support and oil deflector aligns itself when mounted in the proper tapped holes in the unit injectors.

5 Claims, 3 Drawing Sheets

ENGINE WIRING HARNESS SUPPORT WITH INTEGRAL OIL SPILL DEFLECTOR

BACKGROUND OF THE INVENTION

Hydraulically-actuated Electronically-controlled Unit Injectors (HEUI) for diesel engine fuel systems use hydraulic energy of pressurized oil to cause injection of the fuel into the engine cylinder. However, both the start and end of the fuel injection is electronically controlled through a solenoid on the injector. When an injector solenoid is energized it causes the injector poppet valve to lift off its seat which enables high pressure oil to enter the fuel injector causing injection of diesel fuel into the engine cylinder. When the injector solenoid is de-energized the injector oil discharge port is closed. Injection of fuel stops when the electrical signal to the solenoid stops which causes the injector poppet valve to close and the injector oil discharge port to open. Thus, each time an injector of a HEUI system fires it receives electronic signals and discharges oil under high pressure.

Each injector in a HEUI fuel injection system requires a pair of electrical wires for energizing its poppet valve. The electrical wires are connected to the top portion of the injectors that is located under the valve cover. It is the practice to have a bundle of wires, supported by a plurality of individual wire clamps, that are spaced along the length of the valve cover from which a pair of wires branches off to each injector. The individual wire clamps must be secured to the engine block adjacent each injector. The high pressure oil is discharged near the top of the injectors under the valve cover. The discharged high pressure oil must be returned to the low pressure engine sump through a drain. Since the oil is under considerable pressure it is discharged in a pressurized stream that must be controlled by deflecting it downwardly to prevent carryover and excessive lubrication of the valves stems, springs and rocker arms. This oil then flows downwardly to the engine sump. It has been the practice in the past to provide an individual deflector for each of the injectors which must be individually mounted on each injector hold down clamp under the valve cover.

Thus supporting the under valve cover wire harness and providing deflectors for the discharge oil requires numerous parts which must be individually secured to the injector hold down clamp. Each individual component must be properly aligned to insure that it performs as is intended. As a result, these individual components, as well as the assembly time devoted to these components, contribute a sizeable portion to the assembly cost of the engine. Also, when maintaining the engine, each of these individual components must be removed and then properly aligned and reassembled. This contributes considerable to the cost of some repair jobs.

Reference is hereby made to U.S. Pat. No. 5,245,970 for a disclosure of a HEUI system which patent is hereby included by reference as a part of this disclosure.

For the foregoing reasons, there is a need for an improved and more economical ways of supporting the under valve cover wiring harness and for deflecting the discharge oil from the HEUI injectors.

SUMMARY OF THE INVENTION

The present invention is directed to a device that satisfies the need for an improved and more economical way of supporting the under valve cover wiring harness and for deflecting the discharge oil from the HEUI injectors.

This invention of a wiring harness support with integral oil spill deflectors has the advantage of reducing the number of individual parts, each of which required individual alignment and an individual connector, with a single part that requires only a single connector per injector and aligns itself when mounted in the proper tapped holes.

The apparatus consists of a single stamping that functions to support and mount the wiring harness and also to deflect the injector by-pass oil flow.

The present invention is directed to a unitary device that provides a channel for the wiring harness and also deflectors for each injector that is simple and fast to install on an engine head.

The present invention consist of a unitary device including a single channel wiring harness support having integral spill deflectors that is connected to each unit injector by a single bolt.

For the foregoing reasons there is a need for an inexpensive device that can be easily and quickly assembled on the engine block for supporting the under valve cover wiring harness and for deflecting the injector by-pass oil flow.

DETAILED DESCRIPTION OF THE PREFERRED EMBODIMENT

Figure 1:
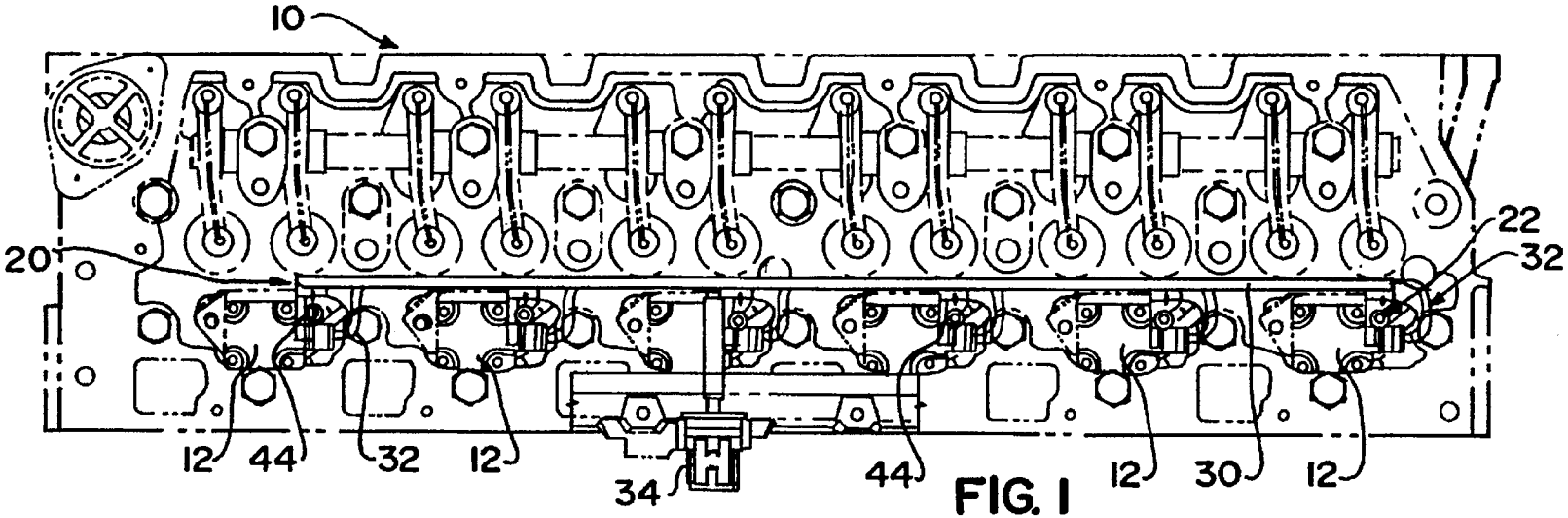
FIG. 1 is a top view of an embodiment of the invention mounted on the top of a cylinder head having six unit injectors in which the cylinder head and the engine components are shown in broken lines.
Figure 2:
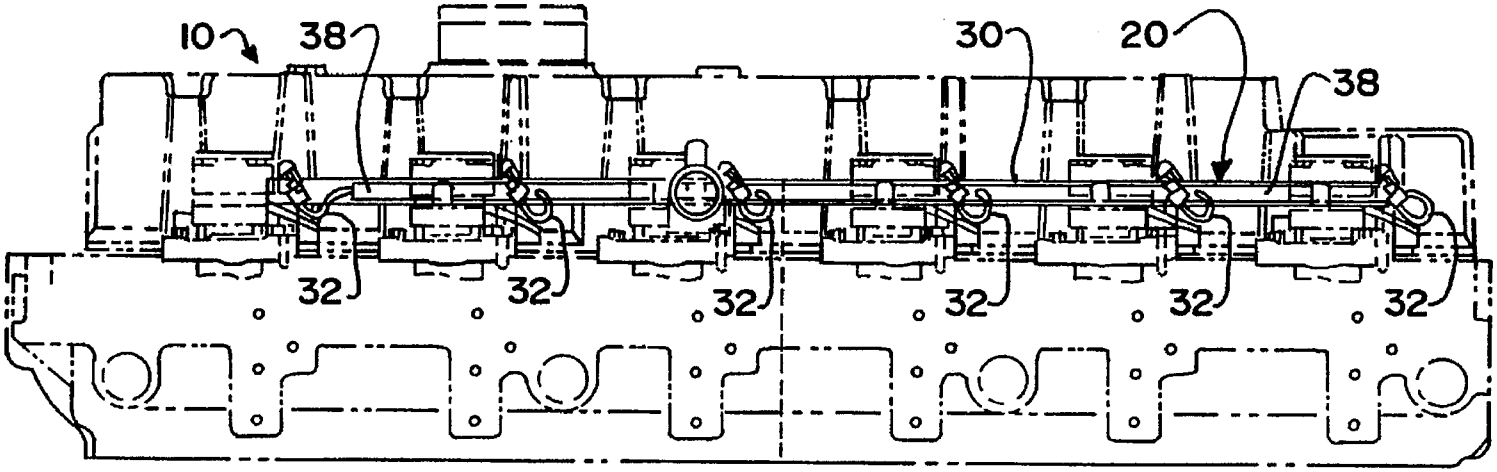
FIG. 2 is a side view of the embodiment of the invention shown in FIG. 1.

FIG. 1 is a top view and FIG. 2 a side view of a cylinder head 10 for a six cylinder in-line engine. Although this invention is illustrated mounted on a six cylinder in-line engine it should be understood that the invention could be used with other type engines such as V-type engines and the sets of cylinders could be more or less than has been illustrated herein. As is conventional there are exposed valve stems, springs and rocker arms on top of the cylinder head which require lubrication. As is conventional a valve head cover is provided which functions to confine the lubricant to this area from which it can drain to the engine sump. The engine wiring harness and oil spill deflector 20 shown in FIG. 1 is connected by bolts 44 to each of the six unit injectors 12. Individual pairs of wires 32 extend from a bundle of wires 38, that are supported in the wiring harness section 30 of the engine wiring harness and oil spill deflector 20, to each of the six unit injectors 12. A bundle of wires 38 is supported in the wiring harness section 30 which are connected to the engine's electrical system through the connector 34. Bolts 44 extend through apertures 42 formed in the mounting section 40 of the engine wiring harness and oil spill deflector 20. The oil spill deflector section 50 of the engine wiring harness and oil spill deflector 20 is supported by and extends upwardly from the mounting section 40 such that it receives oil from the discharge ports 16 of the unit injectors 12 and deflects it downwardly to prevent excessive lubrication of the valve stems and then return the oil to the engine sump.

Figure 6:
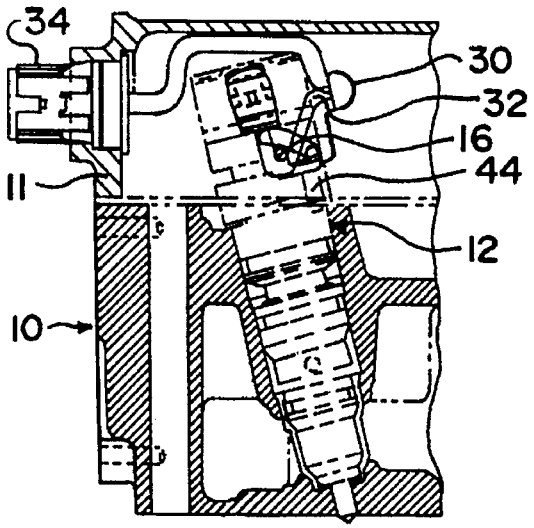
FIG. 6 is an enlarged cross sectional view of a unit injector taken along lines 6—6 of FIG. 1.

FIG. 6, is a cross section view taken along lines 6—6 of FIG. 1, that discloses a unit injector 12 that is mounted in the engine cylinder head. The engine wiring harness and oil spill deflector 20 is shown in cross section as well as the bolt 44 securing it to the unit injector 12. The wiring harness section 30 that carries the bundle of wires 38 as well as the individual wires 32 that extend from the bundle 38 to the unit injector 12 are clearly shown in this Figure. Also seen in this view is the section of the bundle of wires 38 that extends from the wiring harness section 30 to the connector 34 that is carried by the cylinder head cover 11.

Figure 3:
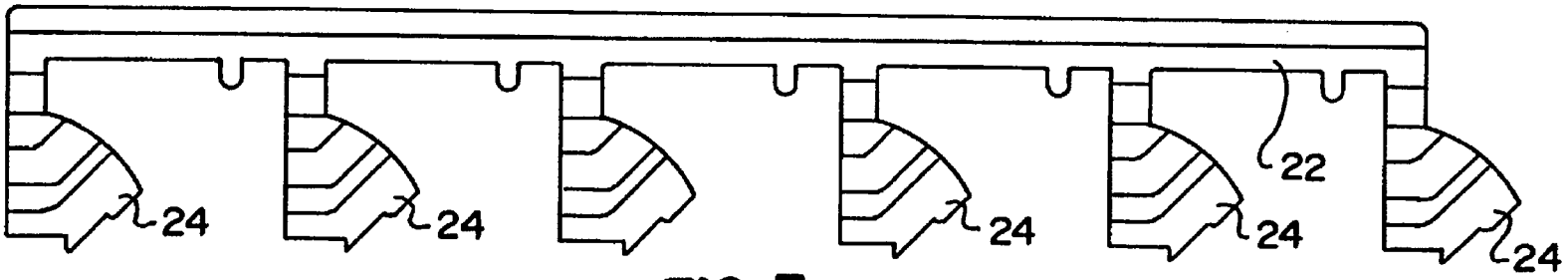
FIG. 3 is a plan view of the sheet metal blank from which the engine wiring harness and oil spill deflector is formed.

FIG. 3 is a plan view of a sheet metal blank from which the engine wiring harness and oil spill deflector are formed. Fold lines are indicated on the sheet metal blank. The sheet metal blank is made up of a longitudinal extending segment of material 22, that extends across the complete set of unit injectors 12 that are to be served by the engine wiring harness and oil spill deflector, and a unit injector segment 24 for each unit injector. The unit injector segments 24 extends from the longitudinal extending segment of material 22. A set of progressive dies are used to stamp the engine wiring harness and oil spill deflector from the sheet metal blank seen in FIG. 3 into the shaped device seen in FIGS. 4 and 5.

Figure 4:
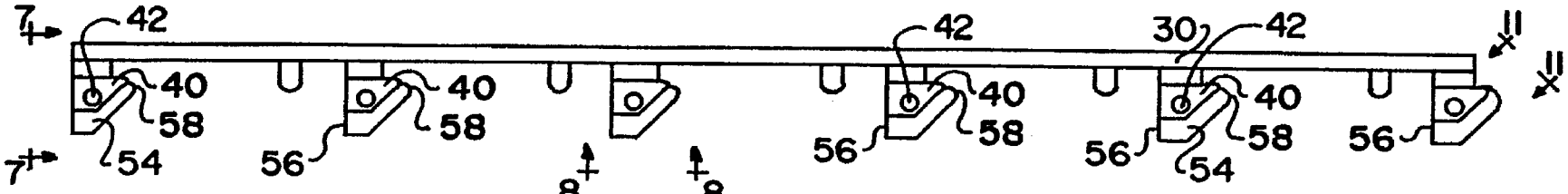
FIG. 4 is a top view of the embodiment of the invention seen in FIG. 1 that is isolated from the cylinder head and engine components.
Figure 5:
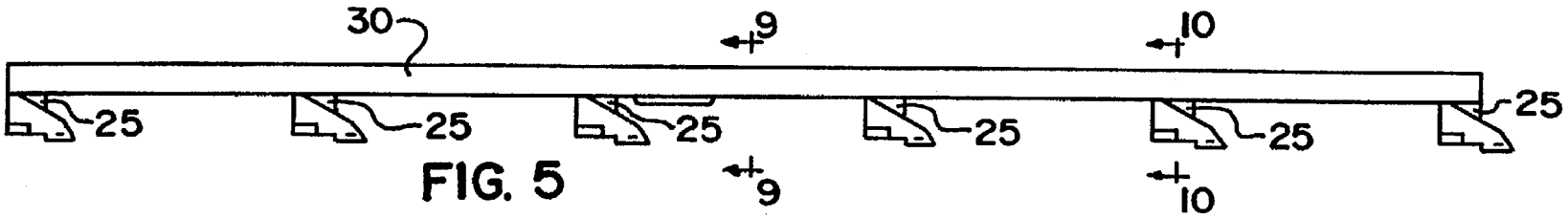
FIG. 5 is a side view of the embodiment of the invention seen in FIG. 2.

FIG. 4 is an isolated top view and FIG. 5 an isolated side view of the engine wiring harness and oil spill deflector that is seen and discussed above with reference to FIGS. 1 and 2.

Figure 7:
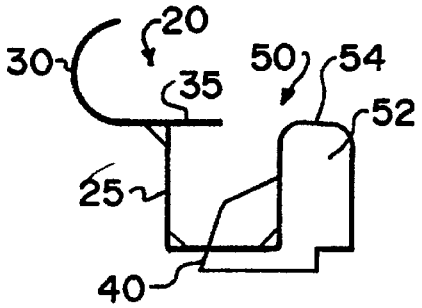
FIG. 7 is an enlarged end view of the isolated engine wiring harness and oil spill deflector taken along lines 7—7 of FIG. 4.

FIG. 7 is an enlarged end view of the engine wiring harness and oil spill deflector 20. In this view the C-shaped wiring harness section 30 is clearly shown along with the fasteners or tabs 35 that can be bent up to secure the bundle of wires 38 in the C-shaped wiring harness 30. An arm 25 extends down from the wiring harness section 30 at each unit injector segment 24 from which the mounting section 40 extends. An aperture 42 (see FIG. 4) is formed in the mounting section 40 through which bolt 44 extends to connect each unit injector segment 24 to its corresponding unit injector 12. The portion of the unit injector segment 24 beyond the mounting section 40 is formed into the oil spill deflector section 50. The oil spill deflector section 50 includes a downwardly opening trough 52 having a closed top 54. The downwardly opening trough 52 extends from a first end 56 to a second end 58 (see FIG. 4). The closed top 54 of the downwardly opening trough 52 extends downwardly from the first end 56 to the second end 58. Also the downwardly opening trough 52 includes a dog-leg turn back toward the wiring harness section 30 as it extends from the first end 56 to the second end 58 (see FIG. 4).

Figure 8:
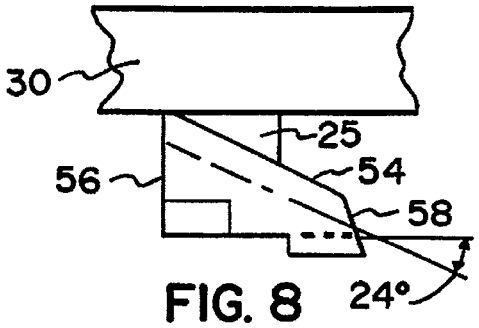
FIG. 8 is an enlarged side view of a portion of the engine wiring harness and oil spill deflector taken along lines 8—8 of FIG. 4.

FIG. 8 is an enlarged side view of one of the oil spill deflector sections. In this view the arm 25 extending down from the wiring harness section 30 as well as the closed top 54 of the downwardly opening trough 52 are clearly shown. In FIG. 8 the downward pitch of the trough 52 from the first end 56 to the second end 58 is indicated to be about 24 degrees.

Figure 9:
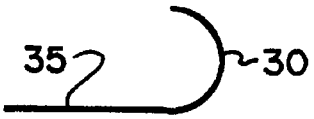
FIG. 9 is an enlarged cross section view of the engine wiring harness and oil spill deflector taken along lines 9—9 of FIG. 5.

FIG. 9 is a cross section view of the wiring harness section 30 taken between unit injector segments 24 and clearly illustrates the C-shaped contour of the wiring harness section 30 which carries the bundle of wires 38 as well as one of the fasteners or tabs 35.

Figure 10:
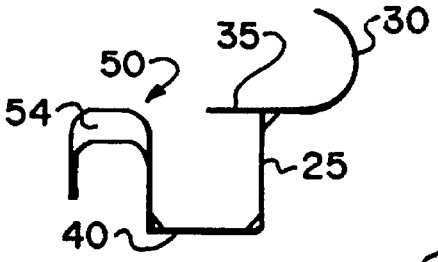
FIG. 10 is an enlarged cross section view of the engine wiring harness and oil spill deflector taken along lines 10—10 of FIG. 5.

FIG. 10 is a cross section view of the engine wiring harness and oil spill deflector that cuts through one of the oil spill deflector sections 50. In this view a portion of the closed top 54 of the downwardly opening trough 52 is visible as well as the wiring harness section 30, arm 25 and mounting section 40.

Figure 11:
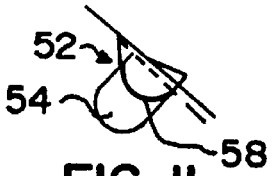
FIG. 11 is an end view of the engine wiring harness and oil spill deflector taken along lines 11—11 of FIG. 4.

FIG. 11 is an end view of the second end 58 of the oil spill deflector section 52. In FIG. 11 the closed top 54 of the downwardly opening trough 52 is seen as well as the open end of the trough 52 at the second end 58.

Figure 12:
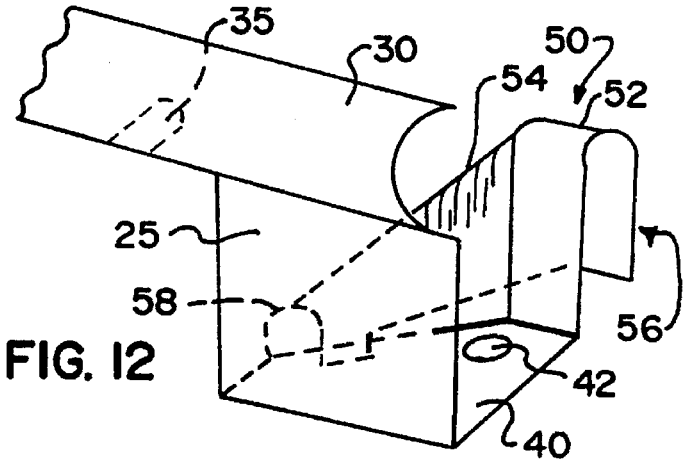
FIG. 12 is schematic sketch of a portion of the engine wiring harness and oil spill deflector.

FIG. 12 is a schematic isometric sketch of a portion of the engine wiring harness and oil spill deflector 20. Although this sketch is not to scale it is helpful in comprehending the relative positions and locations of the various portions and sections of the engine wiring harness and oil spill deflector. As seen in FIG. 12 the discharge oil flows from the discharge port 16 (see FIG. 6) of the unit injector 12 into the upper portion of the downwardly opening trough 52. The stream of oil from the discharge port 16 impacts on the closed top 54 and its direction is turned downwardly toward the cylinder head deck. The excess oil is then returned to the engine sump from which it is recirculated.

The engine wiring harness and oil spill deflector 20 has an aperture 42 for each of its unit injectors 12. When installing the wiring harness and oil spill deflector 20, bolts 44 are inserted through the apertures 42 and threaded into the threaded bores in the unit injectors 12. Since the apertures 42 are located with precision in the engine wiring harness and oil spill deflector 20 no further adjustment or alignment is required. When servicing the engine the engine wiring harness and oil spill deflector 20 is removed as a unit by removing the bolts 44 and can replaced by repeating this simple procedure. No special tools or information are required to remove and replace the engine wiring harness and oil spill deflector 20.

While the invention has heretofore been described in detail with particular reference to the illustrated apparatus, it is to be understood that variations, modifications and the use of equivalent mechanisms can be effected without departing from the scope of this invention. It is, therefore, intended that such changes and modifications be covered by the following claims.

What is claimed is:

1. A wiring harness support and integral oil spill deflector for all injectors of a diesel engine having a HEUI fuel injection system comprising:

a longitudinally extending segment of material that adapted to extend the across all injectors of the HEUI fuel injection system;

said longitudinally extending segment of material including an apertured mounting section for each injector;

each apertured mounting section adapted to be secured to an injector by a connecting device extending through the aperture formed therein;

said wiring harness support and integral oil spill deflector including an oil deflector that has a downwardly opening trough with a closed top and first and second ends, said first end adapted to be at the level of the injector discharge port, said downwardly opening trough with a closed top adapted to extend downwardly from said first end to said second end such that oil flowing therethrough is directed downwardly from the injector discharge port; and said longitudinally extending segment of material includes a coextensive channel portion that is connected to each apertured mounting section that is adapted to receive a wiring harness that includes wires extending to each injector.

2. The invention as set forth in claim 1 wherein said coextensive channel portion including fasteners for securing a wiring harness therein.

3. The invention as set forth in claim 1 wherein said coextensive channel portion is spaced above the closed top of said oil deflector.

4. The invention as set forth in claim 1 wherein said longitudinally extending segment of material is a sheet metal blank wherein said apertured mounting section, oil deflector and coextensive channel portion stamped portions of said sheet metal blank.

5. The invention as set forth in claim 4 wherein said fasteners for securing a wire harness in said coextensive channel are tabs extending from an edge of the channel that can be bent across the channel to secure the wire harness.

* * * * *